United States Patent [19]

Ishii et al.

[11] 4,184,459

[45] Jan. 22, 1980

[54] FUEL INJECTION SYSTEM FOR INTERNAL COMBUSTION ENGINE

[75] Inventors: Yoshiya Ishii, Toyota; Hidetoshi Dohshita, Oobu; Yoshihisa Yamamoto, Kariya; Hiroshi Okazaki, Oobu, all of Japan

[73] Assignee: Nippondenso Co., Ltd., Kariya, Japan

[21] Appl. No.: 882,151

[22] Filed: Feb. 28, 1978

[30] Foreign Application Priority Data

Mar. 7, 1977 [JP] Japan ..... 52-24970

[51] Int. Cl.[2] ..... F02B 3/00; F02M 51/00

[52] U.S. Cl. ..... 123/32 AE; 123/32 G; 123/139 DP; 123/139 E

[58] Field of Search ..... 123/32 G, 32 AE, 139 AE, 123/139 AT, 139 AP, 139 E, 139 DP; 239/89, 90, 91

[56] References Cited

U.S. PATENT DOCUMENTS

| | | | |
|---|---|---|---|
| 3,796,206 | 3/1974 | Links | 123/32 AE |
| 3,837,324 | 9/1974 | Links | 123/32 AE |
| 3,921,604 | 11/1975 | Links | 123/32 AE |
| 4,006,859 | 2/1977 | Thoma | 239/89 |
| 4,036,192 | 7/1977 | Nakayama | 123/139 DP |

FOREIGN PATENT DOCUMENTS

| | | | |
|---|---|---|---|
| 688003 | 2/1953 | United Kingdom | 123/32 G |

*Primary Examiner*—Charles J. Myhre
*Assistant Examiner*—P. S. Lall
*Attorney, Agent, or Firm*—Cushman, Darby & Cushman

[57] ABSTRACT

A fuel injection system for an internal combustion engine of the type so-called unit injector wherein the overflow of fuel under high pressure from a plunger chamber defines the fuel injection cut-off. In order to perform the sharp cut-off, an overflow passage is increased in cross sectional area, and in order to prevent the overflow from the plunger chamber while the fuel is being charged into it, a flow control means such as a spool type directional control valve is inserted into the overflow passage so that when the fuel is being charged into the plunger chamber the communication between the overflow passage and a fuel tank may be positively interrupted. In addition, in order to prevent the fuel recharge with the resulting secondary injection, a flow control means such as a solenoid operated directional control valve is inserted into a fuel supply line communicating between a fuel delivery source and the plunger chamber such that as long as the fuel injection continues or when the fuel injection is zto be completed, the communication between the plunger chamber and the fuel delivery source may be completely cut off.

10 Claims, 5 Drawing Figures

FUEL INJECTION SYSTEM FOR INTERNAL COMBUSTION ENGINE

The present invention relates generally to a fuel injection system for an internal combustion engine and more particularly to a fuel injection system called a unit injector of the type wherein fuel under a high pressure is fed to a fuel injection nozzle by the stroke of a plunger drivingly connected to a piston which recives an injection control pressure and the fuel injection cut-off is defined by the overflow of the fuel under high pressure.

The recent trend of the fuel injection systems for internal combustion engines is toward the rapid fuel injection and the sharp cut-off of the injection so that the contents of pollutants may be minimized in the exhaust gases. One of the very effective measures for attaining the sharp cut-off is to rapidly drop the pressure of the fuel to be fed to the fuel injection nozzle, i.e. the pressure of the fuel in a plunger chamber. In order to attain such rapid pressure drop by the overflow of the fuel from the plunger chamber thereby performing the sharp cut-off of the injection, it is preferable to increase the cross sectional area of an overflow passage through which the plunger chamber is communicated with a low pressure line.

As disclosed in detail in Japanese Patent Laid Open No. 4828/1973, the prior art unit injector determines the injection quantity in terms of the quantity of the fuel charged into the plunger chamber, and in order to increase the fuel metering time interval, thereby improving the metering accuracy, a throat is inserted into a fuel supply line to the plunger chamber so as to restrict the fuel flow. When the cross sectional area of the overflow passage is greater than that of the throat, the fuel which has been charged into the plunger chamber is discharged directly through the overflow passage so that the pressure in the plunger chamber will not rise and consequently the fuel cannot be metered and charged into the plunger chamber. Therefore even though it is preferable to increase as practical as possible the cross sectional area of the overflow passage in order to ensure the sharp and positive cut-off of the fuel injection, the increase is limited in view of the dimentional relationship between the overflow passage and the throat so that the overflow of fuel in a desired quantity cannot be attained in practice.

Adverse effects on metering of the fuel may be avoided by connecting the overflow passage to the fuel supply line to the plunger chamber. However, when the overflow passage is connected to the fuel supply line downstream of the throat, the overflow is limited by the throat regardless of the increase in cross sectional area of the overflow passage so that the overflow in a desired sufficient quantity cannot be obtained either. On the other hand if the overflow passage is connected to the fuel supply line upstream of the throat, a part of the fuel could flow into the plunger chamber without passing through the throat so that inaccurate metering would be resulted especially when the injection quantity is less. Furthermore the pressure of the overflow fuel would cause adverse effects on a pressure source, such as pulsation in fuel pressure. Thus, the prior art fuel injection systems have been unsuccessful in attaining the sharp fuel injection cut-off.

In addition, the prior art fuel injection systems have also various other problems, first, a part of the fuel charged into the plunger chamber is not avoided to be discharged through the overflow passage during the metering and the injection strokes. A second problem is the recharging of fuel with the resultant secondary and tertiary injections. That is, in order to improve the fuel injection characteristics, the rapid pressure build-up in the piston chamber is required so that the piston and the plunger may be moved at a higher speed. To this end, the working fluid under pressure must be introduced into the piston chamber at a high flow rate. In such case the piston which has been moving at a high velocity is suddenly stopped at its lower dead center so that water hammer occurs and subsequently the pressure drop in the piston chamber follows. As a result, the plunger is retracted due to the higher pressure in the plunger chamber so that the fuel is unexpectedly sucked again into the plunger chamber and consequently accidental injections, namely the secondary and tertiary fuel injections, are intermittently repeated until the metering stroke is restarted.

In view of the above, one of the objects of the present invention is to provide a fuel injection system for an internal combustion engine which may substantially overcome the above and other problems encountered in the prior art fuel injection systems and which may ensure sharp injection cut-off.

According to one aspect of the present invention, an overflow means (or an overflow passage) is incorporated into a means for pressurizing and charging the fuel into a fuel injection nozzle so that the rapid pressure drop may be attained in the plunger chamber, whereby the sharp cut-off of fuel injection may be performed. Furthermore, inserted into the fuel overflow passage is a flow control means which selectively establishes or interrupts the communication between the overflow passage and a fuel return line which in turn is communicated with a fuel tank. When the fuel is being charged into the plunger chamber, the flow control means interrupts the communication between the overflow passage and the fuel return line, but establishes the communication between them when the plunger advances into the plunger chamber so that the fuel therein is pressurized and charged into the fuel injection nozzle. Therefore even when the cross sectional area of the overflow passage is increased, the overflow of the fuel which is being metered and charged into the plunger chamber into the fuel return line may be positively avoided, and the rapid pressure drop in the plunger chamber may be ensured by the overflow at a greater flow rate of the fuel through the overflow passage, whereby the sharp cut-off may be ensured.

Another object of the present invention is to provide a fuel injection system of the type described above and further capable of avoiding the secondary injection which follows the main injection.

To this end, the present invention inserts another flow control means in a fuel supply line leading to the plunger chamber which control means prevents the flow of a fuel through the fuel supply line as long as the fuel injection continues or when the fuel injection is to be cut off; that is, as long as the pressurized fuel is being charged from the plunger chamber to the fuel injection nozzle or when the delivery of fuel from the plunger chamber to the fuel injection nozzle is to be completed.

The above and other objects, features and advantages of the present invention will become more apparent from the following description of preferred embodiments thereof taken in conjunction with the accompanying drawings.

Same reference numerals are used to designate similar parts throughout the figures.

Figure 1:
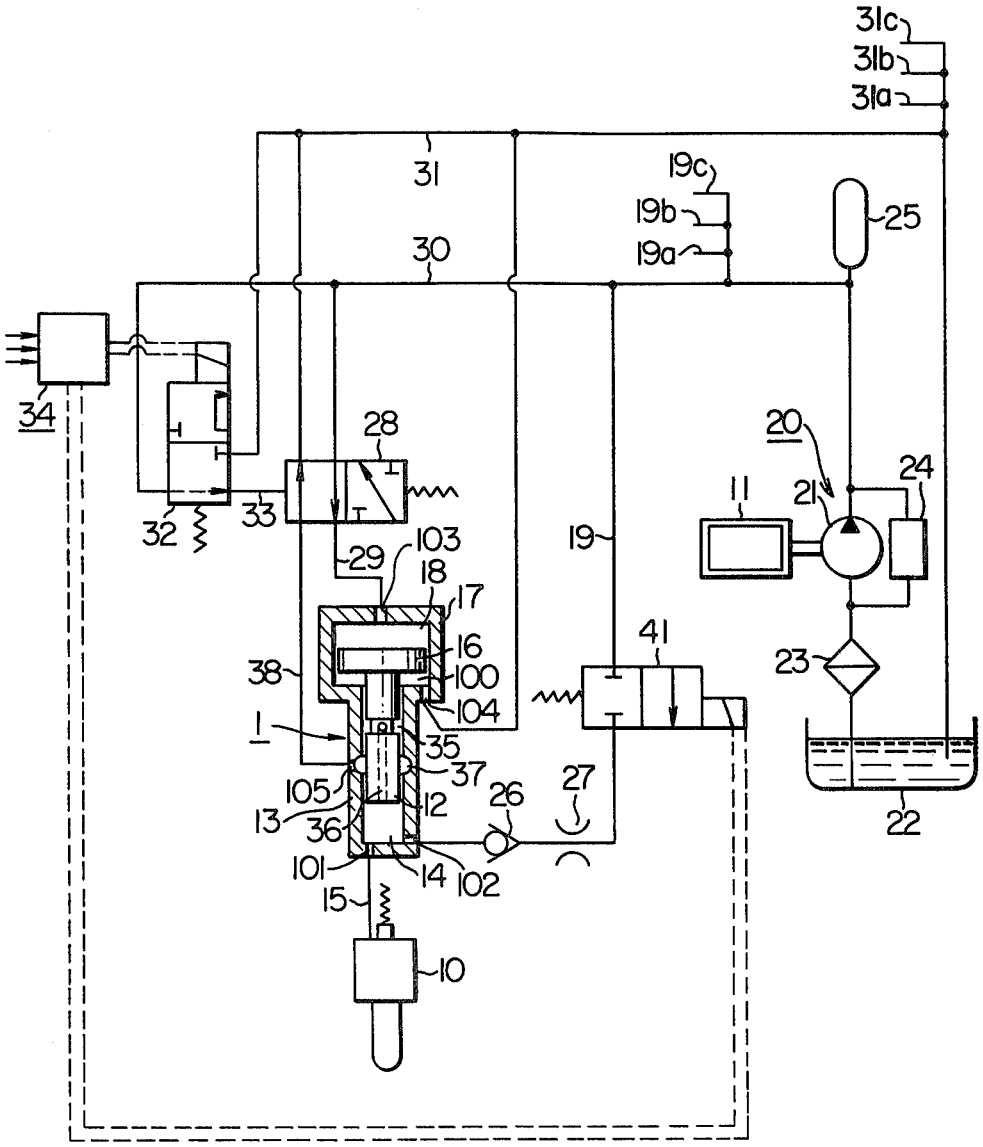
FIG. 1 is a diagrammatic view of a first embodiment of a fuel injection system in accordance with the present invention.

First Embodiment, FIG. 1

Referring to FIG. 1, a first embodiment of a fuel injection system in accordance with the present invention includes a device 1 for charging the fuel under pressure (to be referred to in this specification as "the fuel charging device" for brevity) which charges into a fuel injection nozzle 10 the fuel in quantity metered depending upon the operating condition of an internal combustion engine 11 and in synchronism therewith. The fuel injection nozzle which is of the conventional type is forced to open when the fuel under high pressure is charged therein, thereby injecting the fuel into the engine 11.

The charging device 1 includes a first cylinder 13 and a second cylinder 17 which is formed integral with the first cylinder 13 and which has a cylinder bore larger than the first cylinder 13. A plunger 12 is slidably fitted into the first cylinder 13 for reciprocal movement therein and a piston 16 which is formed integral with the plunger 12 is slidably fitted into the second cylinder 17 for reciprocal movement therein.

A plunger chamber 14 which is defined below the plunger 12 within the first cylinder 13 has an outlet port 101 communicated through a fuel line 15 with the fuel injection nozzle 10 and an inlet port 102 communicated with a first fuel supply line 19 to be described hereinafter.

An upper or piston chamber 18 defined in the second cylinder 17 above the piston 16 has a fuel inlet-outlet port 103 communicated with a fuel supply line 29, and a lower or fuel chamber defined in the second cylinder 17 below the piston 16 has a fuel inlet-outlet port 104 communicated with a fuel return line 31 which in turn is communicated with a fuel tank 22. A spool type four-port, two-position directional control valve 28, which is operated in snychronism with the operation of the engine 11 as will be described in more detail hereinafter, so operates as to charge the fuel under a predetermined pressure into the piston chamber 18 so that the piston 16 is caused to stroke downward and consequently the plunger 12 is also moved downward. During the downward stroke of the piston 16, the fuel in the lower or fuel chamber 100 is forced to return through the inlet-outlet port 104 and the return line 31 to the fuel tank 22.

The plunger 12 is formed with an annular groove 35 intermediate between the ends thereof. This annular groove 35 is hydraulically communicated with the plunger chamber 14 through an axial passage 36 coaxially formed through the plunger 12. An annular groove 37 is formed in the bore of the first cylinder 13 at a predetermined height from the bottom thereof and is adapted to overlap with the annular groove 35 of the plunger 12 when the latter has been moved downward to the predetermined height as will be described in more detail hereinafter. The annular groove 37 is communicated through a fuel overflow port 105 formed through the wall of the first cylinder 13 with a fuel overflow line 38.

The plunger chamber 14 of the fuel charging device 1 is communicated through the first fuel supply line 19 with a fuel delivery device generally indicated by the reference numeral 20. The fuel delivery device 20 includes a pump 21 which is driven by the engine 11 for pumping the fuel from the fuel tank 22 through a filter 23, a pressure regulator valve 24 which regulates the pressure of the pumped fuel to a predetermined of pressure and an accumulator 25 which absorbs the pressure variation of the pumped fuel to be delivered to the first fuel supply line 19.

A nonreturn valve 26 is inserted in the first fuel supply line 19 in order to permit the fuel to flow only toward the plunger chamber 14. A throat 27 is also inserted into the first fuel supply line 19 upstream of the nonreturn valve 26 so that the fuel flows into the plunger chamber 14 for a relatively longer time interval thereby improving accuracy in metering. A solenoid operated directional control valve 41 is inserted in the first fuel supply line 19 upstream of the throat 27 in order to permit or stop the fuel flow into the plunger chamber 14 in response to the electrical control signal transmitted from a control unit 34. That is, when the solenoid of the directional control valve 41 is energized, the control valve 41 is in the position shown in FIG. 1 so that the first fuel supply line 19 is closed, but when the solenoid is de-energized the control valve 41 is moved to the position at which the first fuel supply line 19 is opened so that the fuel flows into the plunger chamber 14.

The spool type directional control valve 28 is inserted into the second fuel supply line 30 and 29 intercommunicating between the fuel delivery device 20 and the piston chamber 18 of the fuel charging device 1 and connected to the fuel return line 31 and the fuel overflow line 38. The spool type directional control valve 28 is further hydraulically and operatively coupled to a further solenoid operated directional control valve 32 through a pilot line 33. As with the solenoid operated directional control valve 41 inserted in the first fuel supply line 19, the solenoid operated directional control valve 32 operates in response to the electrical control signal transmitted from the control unit 34, whereby the spool type directional control valve 28 is controlled. That is, when the solenoid operated control valve 32 is energized, the control valve 32 permits the pilot flow of fuel under pressure from the fuel delivery device 20 through the fuel supply line 30 into the spool type control valve 28 through the pilot flow line 33 so that the spool type directional control valve 28 is moved to the position where the fuel lines 30 and 29 are communicated with each other to deliver the fuel into the piston chamber 18 and the fuel return line 31 is communicated with the fuel overflow line 38 as shown in FIG. 1. On the other hand, when the solenoid operated directional control valve 32 is de-energized, the pilot flow line 33 is communicated with the fuel return line 31 so that the spool type directional control valve 28 is moved to a second position where the fuel supply line 29 is disconnected from the fuel supply line 30 and is communicated with the fuel return line 31 while the fuel overflow line 38 is disconnected from the fuel return line 31. Therefore the spool type directional control valve 28 and the solenoid operated directional control valve 32 constitute flow control means for controlling the flow of fuel through the fuel line 29 and for controlling the flow of fuel through the overflow line 38.

The control unit 34 is of the conventional type which applies electrical control signals to the solenoid operated directional control valves 41 and 32 in synchronism with the engine operation, i.e. the crankshaft rotation of the engine, and depending upon the operating condition of the engine 11, thereby controlling the operations of the, various control means.

Figure 2:
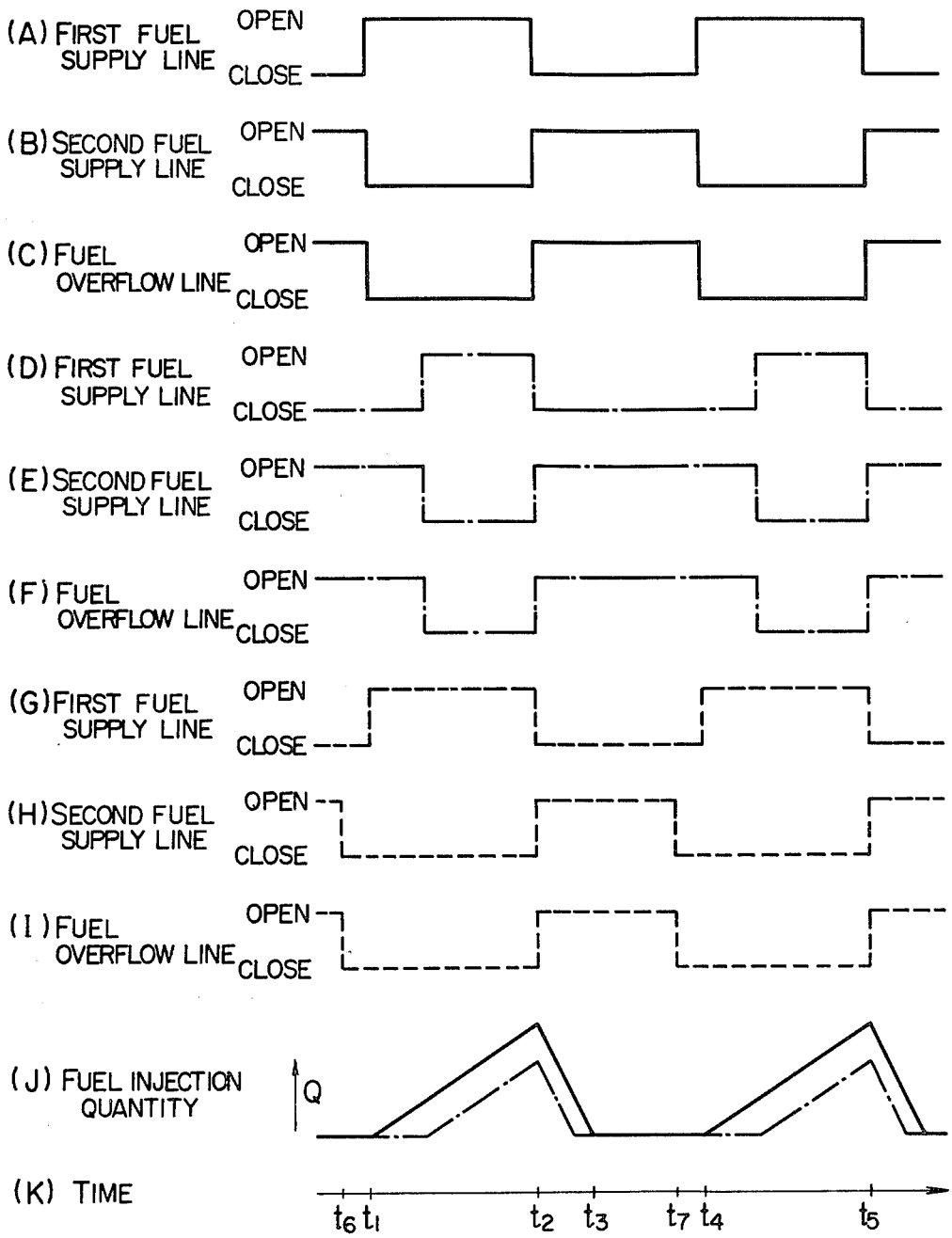
FIG. 2 is a timing diagram used for the explanation of the mode of operation of the first embodiment.

Next referring further to FIG. 2 showing the opening and closing timing diagram of the first fuel supply line 19, the second fuel supply line 29 and 30 and the fuel overflow line 38, the mode of operation of the first embodiment with the above construction will be described. At a time $t_1$, the first fuel supply line 19 is opened while the fuel supply lines 30 and 29 are disconnected from each other, the fuel over flow line 38 is disconnected from the fuel return line 31 and the fuel line 29 is communicated with the fuel return line 31. Therefore the fuel under pressure is delivered from the fuel delivery device 20 through the throat 27 and the nonreturn valve 26 into the plunger chamber 14 of the fuel charging device 1. When the fuel in quantity depending upon the operating condition of the engine 11 has been charged into the chamber 14, i.e. at a time $t_2$, the first fuel supply line 19 is closed while the fuel line 29 and the fuel overflow line 38 are communicated with the fuel supply line 30 and the fuel return line 31, respectively, as shown in FIG. 1 so that the fuel under the predetermined pressure is charged into the chamber 18 through the fuel lines 30 and 29.

The fuel charged into the piston chamber 18 has the same pressure as that of the fuel charged into the plunger chamber 14. However, since the area of the upper end of the piston 16 is greater than the area of the lower end of the plunger 12, the piston 16 and hence the plunger 12 are caused to move downward so that the fuel in the plunger chamber 14 is pressurized and charged through the fuel line 15 into the nozzle 10 which in turns injects the fuel into the engine 11.

At a time $t_3$ the annular groove 35 of the plunger 12 overlaps with the annular groove 37 of the first cylinder 13 so that the plunger chamber 14 below the plunger 12 is communicated through the axial passage 36 with the annular groove 37 and hence with the overflow port 105 which in turn is communicated with the overflow line 38. Therefore the excess fuel in the plunger chamber 14 overflows into the fuel overflow line 38 so that the charging of fuel into the fuel injection nozzle 10 is stopped and consequently the fuel injection is cut off. Since the cross sectional area of the overflow passage which is defined by the overlap between the annular grooves 35 and 37 is large, the fuel under high pressure in the plunger chamber 14 is caused to rapidly overflow into the fuel overflow line 38. As a result, the pressure within the plunger chamber 14 very rapidly drops so that the sharp cut-off of fuel injection may be ensured.

When the fuel is forced to flow into the piston chamber 18 at a faster flow rate in order to cause the piston 16 and the plunger 12 to move downward quickly, thereby improving the fuel injection characteristics, water hammer occurs due to the sudden stop of the downward movement of the piston 16 at its lower dead point and subsequently the pressure drop results in the piston chamber 18 for a short time. As a result, the piston 16 and the plunger 12 are slightly lifted so that the plunger chamber 14 is increased in volume and consequently the recharge of fuel occurs. As a consequence, the secondary injection would follow. However, according to the present invention the solenoid operated directional control valve 41 which is inserted into the first fuel supply line 19 positively closes the latter so that the recharge of fuel into the plunger chamber 14 will not occur at all. Therefore the secondary injection can be positively avoided.

At a time $t_4$ the solenoid operated directional control valve 32 is de-energized so that the spool type directional control valve 28 is moved to the second position wherein the piston chamber 18 is communicated through the fuel line 29 with the fuel return line 31 so that the pressure in the piston chamber 18 is reduced while the fuel overflow line 38 is disconnected from the fuel return line 31. Simultaneously the solenoid operated directional control valve 41 is opened so that the fuel under pressure is charged again into the plunger chamber 14 in the manner described above so that the plunger 12 and the piston 16 are caused to move upward. Since the overflow line 38 is disconnected from the fuel return line 31, no overflow from the plunger chamber 14 occurs even when the annular grooves 35 and 37 overlap with each other. The quantity of fuel charged into the plunger chamber 14 which is in close relation with the injection quantity is dependent upon a time interval during which the spool type directional control valve 28 remains its second operative position. The maximum injection quantity is attained when the plunger 12 is moved to its upward stroke end. The throat 27 serves to control the flow of fuel into the plunger chamber 14 and to lengthen the fuel metering time interval, whereby even when the fuel injection quantity is small as shown by dotted lines at (D), (E) and (F) in FIG. 2, the fuel may be metered with a higher degree of accuracy. After the fuel has been metered in the plunger chamber 14 in the manner described above, the plunger 12 is turned to move downward to inject the metered fuel from the fuel injection nozzle 10. This fuel injection procedure is repeated in synchronism with the operation of the engine 11.

As described above, according to the present invention, the sharp cut-off of fuel injection may be ensured so that the contaminants in the exhaust gases may be considerably minimized. Furthermore with the spool type directional control valve 28 and the solenoid operated directional control valve 41, the fuel may be metered with a higher degree of accuracy so that an optimum fuel injection may be ensured. Moreover the secondary injection which may adversely affect the operation of the engine can be positively avoided.

When the spool type directional control valve 28 and the solenoid operated directional control valve 41 can be operated in complete synchronism with each other, the latter functions as a nonreturn valve so that the nonreturn valve 26 may be eliminated.

So far the spool type directional control valve 28 has been described as controlling the quantity of fuel charged into the plunger chamber 14, but it is to be understood that the solenoid operated directional control valve 41 may be used for controlling the metering quantity of the fuel to be charged into the plunger chamber 14. In this case, the complete synchronization between the spool type directional control valve 28 and the solenoid operated directional control valve 41 is not required. That is, as shown by broken lines at (G), (H) and (I) in FIG. 2, the spool type control valve 28 may be so operated as to disconnect the communication between the fuel lines 29 and 30 and the communication between the fuel overflow line 38 and the fuel return line 31 at $t_6$ or $t_7$ before the solenoid operated directional control valve 41 opens the first fuel line 19 at $t_1$ or $t_4$. And when the solenoid operated directional control valve 41 has closed the first fuel supply line 19 to complete the metering of fuel at $t_2$ or $t_5$, the spool type directional control valve 28 may be so operated to establish the communications between the fuel supply lines 30 and 29 and between the fuel overflow lines 38 and the fuel return line 31. According to this procedure, the overflow of the fuel from the plunger chamber 14 into the overflow line 38 and to the fuel return line 31 may be positively prevented when the fuel is being charged into the plunger chamber 14. Furthermore the positive overflow of fuel from the plunger chamber 14 may be ensured when the fuel injection has been completed.

Figure 3:
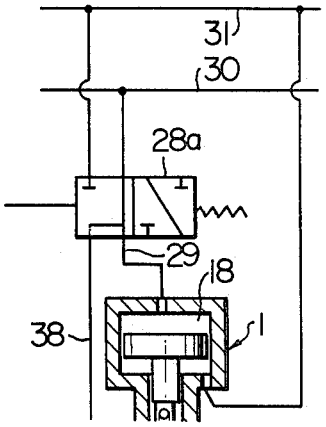
FIGS. 3 and 4 are fragmentary diagrammatic views of second and third embodiments of the present invention, respectively.

Second Embodiment, FIG. 3

The second embodiment shown in FIG. 3 is substantially similar in construction to the first embodiment described above with reference to FIG. 1 except that the fuel which overflows from the plunger chamber 14 is returned not to the return line 31 but to the fuel supply line 30. Therefore a spool type directional control valve 28*a* is so modified that at a first position the fuel supply line 30 is communicated not only with the piston chamber 18 but also with the overflow line 38 and at a second position the piston chamber 18 is communicated with the fuel return line 31 while the fuel overflow line 38 is completely disconnected from the return line 31 as with the first embodiment.

In addition to the advantages of the first embodiment, the second embodiment has a further advantage in that the fuel under high pressure which overflows from the plunger chamber 14 is not wasted for nothing.

Figure 4:
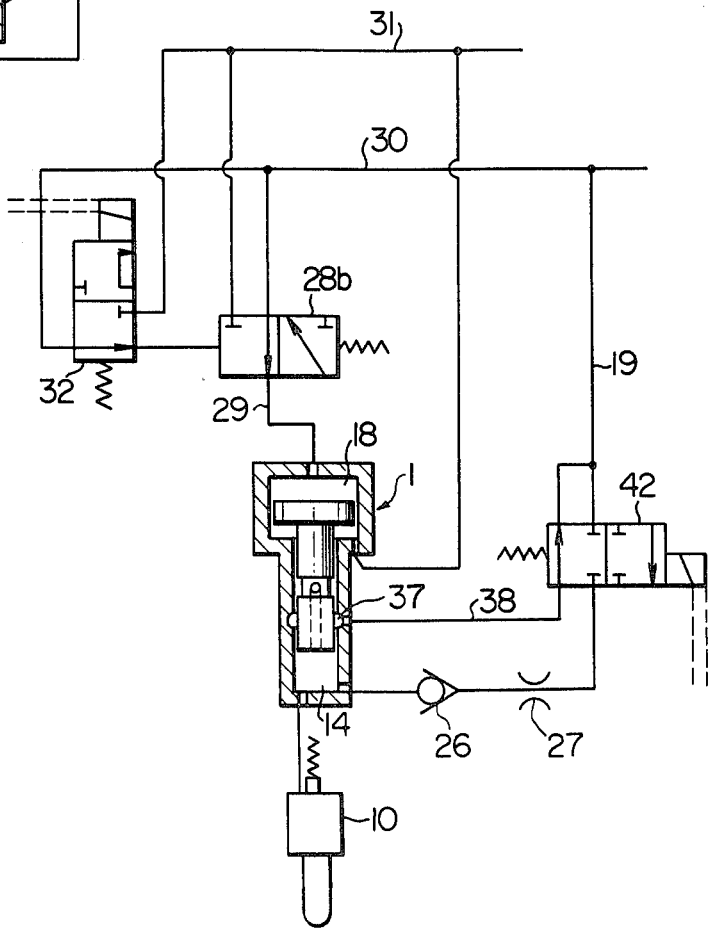

Third Embodiment, FIG. 4

In the third embodiment shown in FIG. 4, a spool type three-way directional control valve 28*b* is used as one flow control means and the solenoid operated directional control valve 42 is so constructed and arranged as to function as additional flow control means. That is, at a first operative position of the directional control valve 28*b*, the piston chamber 18 is communicated through the fuel line 29 with the fuel supply line 30 while at a second position the piston chamber 18 is communicated with the fuel return line 31. When the spool type directional control valve 28*b* is in its first position described above, the solenoid operated directional control valve 42 is in its first position where the fuel overflow line 38 is communicated with the fuel supply line 19 upstream of the first solenoid operated directional control valve 42 while the flow of fuel to the plunger chamber 14 through the first fuel supply line 19 is prevented. When the spool type directional control valve 28*b* is in its second position, the solenoid operated directional control valve 42 is in its second position wherein the flow of fuel through the first fuel supply line 19 to the plunger chamber 14 is permitted while the fuel overflow line 38 is disconnected from the first fuel supply line 19. Except the arrangements described above, the third embodiment is substantially similar in construction to the first embodiment.

Figure 5:
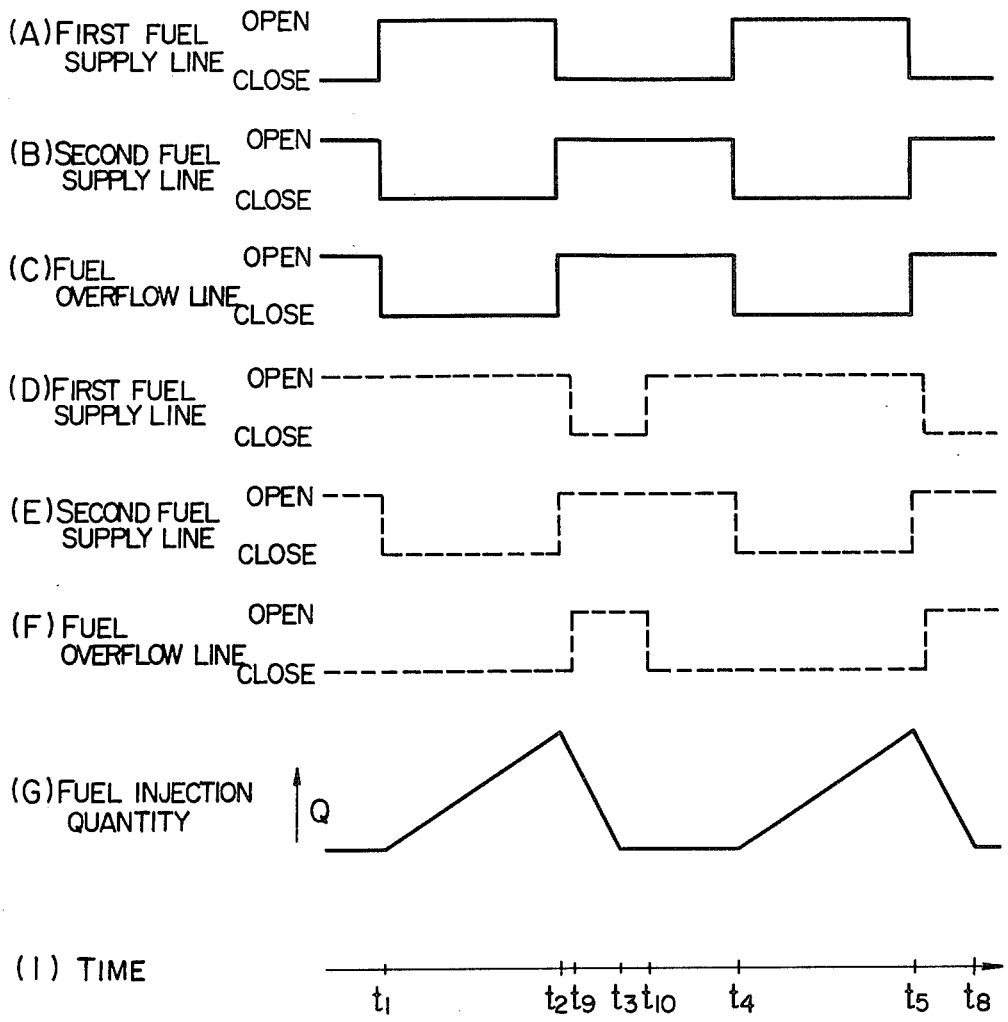
FIG. 5 is a timing diagram used for the explanation of the mode of operation of the third embodiment shown in FIG. 4.

As shown at (A), (B) and (C) in FIG. 5 the spool type directional control valve 28*b* and the solenoid operated directional control valve 42 are operated in synchronism with each other so that the mode of operation of the third embodiment is similar to that of the first embodiment. That is, at $t_1$ or $t_4$ in FIG. 5, the flow of fuel into the plunger chamber 14 is started and is stopped at $t_2$ or $t_5$ to complete the fuel metering and to start the fuel injection. At $t_3$ or $t_8$ the fuel injection (or the charging of fuel to the nozzle 10) is stopped.

In the third embodiment, the synchronous operation between the spool type directional control valve 28*b* and the solenoid operated directional control valve 42 is not required as will be described hereinafter. That is, as indicated by broken lines at (D), (E) and (F) the solenoid operated directional control valve 42 may be operated to take the first position from a time $t_9$ prior to the fuel injection cut-off time $t_3$ to a time $t_{10}$ after the time $t_3$ so that the overflow of fuel may be permitted when the fuel injection cut-off is required. Furthermore the overflow of fuel from the plunger chamber 14 may be positively avoided when the fuel is being charged into the plunger chamber 14.

So far the fuel under pressure is delivered from a single fuel delivery device 20 to both the piston chamber 18 and the plunger chamber 14 so as not only to charge the fuel into the plunger chamber 14 but also to actuate the piston 16, but it is to be understood that any fluid other than the fuel may be charged under pressure into the piston chamber 18 from a separate fluid delivery source. The effects and advantages of such modification are similar to those of the preferred embodiments described above.

The solenoid control valves 41 or 42 and the spool type directional control valve 28, 28*a* or 28*b* may be formed as a unitary construction. In addition, it is to be understood that the present invention is not limited to the preferred embodiments described above and that various modifications may be effected without departing the true spirit of the present invention.

As described hereinbefore, according to the present invention, even if the overflow passage is so designed as to permit the maximum rapid overflow of the fuel under high pressure at the injection cut-off, disadvantages in the fuel metering which would result from such design may be prevented owing to the provision of the control valve in the overflow line. As a result, an optimum fuel injection may be ensured and the sharp injection cut-off may be obtained which is essential for an optimum operation of the engine.

Furthermore the solenoid operated directional control valve inserted in the first fuel supply line may positively avoid the secondary injection, whereby optimum fuel injection characteristics may be attained.

What is claimed is:

1. A fuel injection system for an internal combustion engine comprising;

(a) at least one fuel injection nozzle attached to the engine for injecting fuel under high pressure into the engine;

(b) means operated in synchronism with the operation of the engine for charging into said fuel injection nozzle pressurized fuel in quantity depending upon the operating condition of the engine, said fuel charging means having a first cylinder, a plunger slidably fitted into said first cylinder to define a plunger chamber in said first cylinder, said plunger chamber being hydraulically communicated with said fuel injection nozzle, a second cylinder formed integral with said first cylinder and having a bore diameter greater than said first cylinder, a piston formed integral with said plunger and slidably fitted into said second cylinder to define a piston chamber in said second cylinder, said piston being adapted to move said plunger in a direction as to reduce the volume of said plunger chamber thereby charging the fuel from the plunger chamber into said fuel injection nozzle when said piston chamber is charged with pressurized fluid, a fuel overflow port formed through the wall of said first cylinder, and an overflow passage formed through said plunger for permitting the communication of said plunger chamber with said fuel overflow port when said plunger is moved in said direction by a predetermined stroke;

(c) a first fuel supply line for delivering fuel under a predetermined pressure to said plunger chamber of said fuel charging means from a fuel tank;

(d) a second fuel supply line for delivering the fuel under a predetermined pressure to said piston chamber of said fuel charging means from said fuel tank;

(e) a fuel overflow line communicated with said fuel overflow port of said fuel charging means for permitting the overflow of the fuel from said plunger chamber;

(f) a first flow control means inserted in said second fuel supply line for opening or closing of said second fuel supply line, said first flow control means having a first position at which said second fuel supply line is communicated with said piston chamber whereby the fuel under the predetermined pressure is charged into said piston chamber and a second position at which said piston chamber is disconnected from said second fuel supply line and is communicated with a fuel return line which in turn is communicated with said fuel tank; and (g) a second flow control means inserted in said fuel overflow line for opening or closing said fuel overflow line; and (h) a drive means for operating said first and second flow control means in synchronism with the operation of the engine in such a way that said second flow control means opens said fuel overflow line when said first flow control means is in said first position and when the charging of the fuel under pressure from said fuel charging means to said nozzle is completed and closes said fuel overflow line when said first flow control means is in said second position to charge the fuel into said plunger chamber of said fuel charging means.

2. A fuel injection system for an internal combustion engine according to claim 1 further comprising;

a third flow control means inserted into said first fuel supply line for opening said first fuel supply line when said first fuel control means is in said second position to charge the fuel into said plunger chamber and closing said first fuel supply line when the charging of the fuel under pressure from said fuel charging means to said nozzle is completed.

3. A fuel injection system for an internal combustion engine comprising;

(a) at least one fuel injection nozzle attached to the engine for injection fuel under high pressure into the engine, (b) means operated in synchronism with the operation of the engine for charging into said fuel injection nozzle pressurized fuel in quantity depending upon the operating condition of the engine, said fuel charging means having a first cylinder, a plunger slidably fitted into said first cylinder to define a plunger chamber in said first cylinder, said plunger chamber being hydraulically communicated with said fuel injection nozzle, a second cylinder formed integral with said first cylinder and having a bore diameter greater than said first cylinder, a piston formed integral with said plunger and slidably fitted into said second cylinder to define a piston chamber in said second cylinder, said piston being adapted to move said plunger in a direction as to reduce the volume of said plunger chamber thereby charging the fuel from the plunger chamber into said fuel injection nozzle when said piston chamber is charged with pressurized fluid, a fuel overflow port formed through the wall of said first cylinder, and an overflow passage formed through said plunger for permitting the communication of said plunger chamber with said fuel overflow port when said plunger is moved in said direction by a predetermined stroke;

(c) a first fuel supply line for delivering fuel under a predetermined pressure into said plunger chamber of said fluid charging means from a fuel tank, (d) a first flow control means inserted in said first fuel supply line for opening or closing of said first fuel supply line;

(e) a second fuel supply line for delivering the fuel under a predetermined pressure into said piston chamber of said fuel charging means from said fuel tank, (f) a second flow control means inserted into said second fuel supply line for opening or closing the same, said second flow control means having a first position at which said second fuel supply line is communicated with said piston chamber, whereby the fuel under the predetermined pressure is charged into said piston chamber and a second position at which said piston chamber is disconnected from said second fuel supply line and is communicated with said fuel tank;

(g) a fuel overflow line for communicating said fuel overflow port of said fuel charging means with at least one of said fuel tank, said first fuel supply line upstream of said first flow control means and said second fuel supply line upstream of said second flow control means;

(h) a third flow control means inserted into said fuel overflow line for opening or closing said fuel overflow line;

(i) a drive means for operating said first, second and third flow control means in synchronism with the operation of the engine, said drive means controlling a time interval during which said first flow control means is opening said first fuel supply line or a time interval during which said second flow control means is closing said second fuel supply line, thereby controlling the quantity of the fuel to be charged into said plunger chamber depending upon the operating condition of the engine, said drive means also operating said third flow control means in such a way that said fuel overflow line is closed at least when the fuel is being charged into said plunger chamber and that said fuel overflow line means is opened at least when the charging of the pressurized fuel into said fuel injection nozzle from said plunger chamber is completed, and said drive means operating said first flow control means in such a way that at least when the charging of said pressurized fuel into said fuel injection nozzle from said plunger chamber is completed, said first fuel supply line is closed.

4. In a fuel injection system for an internal combustion engine of the type comprising:

at least one fuel injection nozzle attached to the engine for injecting fuel under high pressure into the engine;

means operated in synchronism with the operation of the engine for charging the fuel to said fuel injection nozzle in a quantity depending upon the operating condition of the engine, said fuel charging means including a first cylinder, a plunger slidably fitted into said first cylinder for reciprocal movement therein and defining in said first cylinder a plunger chamber which is communicated with said fuel injection nozzle, a second cylinder having a bore diameter greater than that of said first cylinder, a piston slidably fitted into said second cylinder for reciprocal movement therein and defining in said second cylinder a piston chamber, means for operatively connecting said piston to said plunger in such a relation that the volume of said plunger chamber decreases as the volume of said piston chamber increases, a fuel overflow port formed through the cylinder wall of said first cylinder, a fuel overflow passage formed in said plunger and adapted to establish the communication between said plunger chamber and said fuel overflow port when said plunger is in a predetermined position near the end of the forward stroke of said plunger;

a fuel supply means including a fuel tank, means for pumping fuel from said fuel tank and delivering fuel under a predetermined pressure and a fuel supply line for communicating said pumping means with said plunger chamber of said fuel charging means;

a fuel overflow line connected to said fuel overflow port of said fuel charging means; and fluid control means for admitting and exhausting working fluid into and from said piston chamber in synchronism with the engine operation and depending upon the operating condition of the engine thereby controlling the reciprocal movement of said piston;

an improvement comprising a valve means provided in said fuel overflow line for opening or closing said fuel overflow line and a valve operating means for operating said valve means in such a way that said valve means closes said fuel overflow line at least when the fuel is being charged into said plunger chamber through said fuel supply line and opens said fuel overflow line at least when said plunger in the forward stroke has been displaced to said predetermined position.

5. An improvement according to claim 4, further comprising a second valve means provided in said fuel supply line for permitting the flow of the fuel through said fuel supply line at least when the working fluid is being exhausted from said piston chamber and preventing the flow of the fuel through said fuel supply line at least when said plunger in the forward stroke has been displaced to said predetermined position.

6. An improvement according to claim 5, wherein said fuel control means includes a second fuel supply line for communicating said pumping means with said piston chamber of said fuel charging means, a fuel return line for communicating said piston chamber with said fuel tank, a directional control valve movable between a first position at which the fuel is permitted to flow through said second fuel supply line while prevented to flow through said fuel return line and a second position at which the fuel is prevented to flow through said second fuel line while permitted to flow through said fuel return line, said valve operating means shifting said directional control valve between said first and second position in synchronism with the engine operation and in dependence upon the operating condition of the engine.

7. An improvement according to claim 6, wherein said fuel overflow line is connected to said fuel return line and said valve operating means further operates said first valve means in said fuel overflow line in such a way that when said directional control valve is shifted to said first position, said first valve means is opened and when said directional control valve is shifted to said second position, said first valve means is closed.

8. An improvement according to claim 6, wherein said fuel overflow line is connected to said second fuel supply line and said valve operating means further operates said first valve means in said overflow line in such a way that when said directional control valve is shifted to said first position, said first valve means is opened and when said directional control valve is shifted to said second position, said first valve means is closed.

9. An improvement according to claim 6, wherein said fuel overflow line is connected to said first fuel supply line upstream of said second valve means and said valve operating means further operates said first valve means in said overflow line and said second valve means in said first fuel supply line in such a way that when said second valve means is opened, said first valve means is closed and when said second valve means is closed, said first valve means is opened.

10. An improvement according to claim 9, wherein said first and second valve means are formed in a single three-way directional control valve which comprises a first port communicating with said pumping means, a second port communicating with said plunger chamber of said fuel charging means, a third port connected to said fuel overflow line, and a valve member movable between a first position at which said first port is communicated with said second port and a second position at which said first port is communicated with said third port.

* * * * *